United States Patent [19]

Combs

[11] 4,287,512

[45] Sep. 1, 1981

[54] MAGNETIC LOCKING METHODS AND APPARATUS

[75] Inventor: C. Marlon Combs, Claremont, Calif.

[73] Assignee: Dynametric, Inc., Pasadena, Calif.

[21] Appl. No.: 136,012

[22] Filed: Mar. 31, 1980

[51] Int. Cl.[3] ..... G08B 13/22

[52] U.S. Cl. ..... 340/542; 324/260; 340/547; 361/143; 73/DIG. 3

[58] Field of Search ..... 340/542, 547, 687, 685, 340/540; 73/DIG. 3; 324/260, 251; 361/143, 144, 145

[56] References Cited

U.S. PATENT DOCUMENTS

| | | | |
|---|---|---|---|
| 3,060,370 | 10/1962 | Varterasian | 73/DIG. 03 |
| 3,195,043 | 7/1965 | Burig et al. | 324/251 |
| 3,426,166 | 2/1969 | Canceill | 340/547 |
| 3,618,066 | 11/1971 | Brommont | 361/144 |
| 4,208,656 | 6/1980 | Littwin | 340/685 |

*Primary Examiner*—Glen R. Swann, III

*Attorney, Agent, or Firm*—Benoit Law Corporation

[57] ABSTRACT

Matching components of a magnetic locking assembly are magnetically attracted into mating relationship until a predetermined magnetic flux is established in one of the components. Such established predetermined flux is monitored to detect locking power diminutions between the locking assembly components. External magnetic fields applied to the locking assembly in an attempt to counterfeit the mentioned predetermined magnetic flux may be detected and indicated for security reasons.

30 Claims, 5 Drawing Figures

MAGNETIC LOCKING METHODS AND APPARATUS

BACKGROUND OF THE INVENTION

The subject invention relates generally to systems for preventing removal or relative motion between parts, to methods and apparatus for operating magnetic locking assemblies, to magnetic locks and similar fastening devices, and to monitoring and tampering detection systems for magnetic locking assemblies and similar structure.

For a magnetic lock to be locked, two criteria must be met. First, the lock must be energized or magnetized at or near full power, such that the requisite holding magnetic field is present. Secondly, the lock must be properly mated to its strike plate, with no appreciable amount of debris or air gap between the face of the lock and the strike plate. If, and only if, these two conditions are met, the magnetic lock may be said to be "locked"; that is, to be holding at full force. In practice, these criteria apply generally to various devices and apparatus employing a magnetic locking assembly, including not only locks, but also such devices as magnetic fasteners, mounting structures, lifters, couplings, theft prevention contrivances, and the like.

Existing magnetic locking systems have fallen short of meeting the above criteria in a reliable and reasonably tamperproof manner. For instance, existing magnetic locks employ such proximity sensors as electric switches actuated by the strike plate or magnetic reed switches actuated by a permanent magnet located in or at the strike plate of the lock. Such arrangements, however, at best are only capable of detecting the presence of the strike plate at the lock, while remaining incapable of ascertaining whether the electromagnetic lock is energized and holding at full force. In consequence, existing systems of the type under consideration will provide a deceptive "all is well" indication when the magnetic lock has not even been energized.

As another drawback, existing proximity sensors and other supposed safety features are easily defeated by external magnetic fields or other force-producing contrivances.

In a similar vein, it is a well-known practice of intruders and saboteurs to defeat or impair the operation of magnetic locking devices by an artificial provision of debilitating air gaps or other artifacts which weaken the holding power of the locking assembly upon energization thereof. For instance, even a thin tape applied to the pole face of a magnetic lock during its open condition, will render it relatively easy for an intruder to push open a supposedly securely locked assembly. No effective methods for precluding such tampering and intrusions have heretofore been known.

It is a general object of this invention to overcome the disadvantages and meet the needs expressed or implicit in the above statement or in other parts hereof.

It is a germane object of this invention to provide improved magnetic locking assemblies in a broad sense, including electromagnetic locks, magnetic theft prevention systems, magnetic fasteners, mounting devices and similar apparatus.

It is a related object of this invention to provide reliable status detection, verification and indication systems for magnetic locks.

It is a related object of this invention to detect or identify locking power diminutions between components of magnetic locking assemblies.

It is a germane object of this invention selectively to provide alarm conditions in response to locking power diminutions.

It is also an object of this invention to detect or identify instances of tampering with magnetic locks and attempts at defeating their effective operation.

Other objects will become apparent in the further course of this disclosure.

SUMMARY OF THE INVENTION

From a first aspect thereof, the subject invention resides in methods and apparatus for operating a magnetic locking assembly having matching first and second magnetizable components. The invention according to this aspect thereof comprises, in combination, the steps of, or means for, magnetically attracting the first and second components into mating relationship whereby a predetermined magnetic flux is established in one of the components, and monitoring such established predetermined flux to detect locking power diminutions between components of the locking assembly.

According to a second aspect of the subject invention, a pair of magnetic pole faces is provided in one of two first and second components of the magnetic locking assembly. The first and second components are magnetically attracted into mating relationship whereby a predetermined magnetic flux is established between the pole faces, and such established predetermined flux is monitored between the mentioned pole faces to detect locking power diminutions between the components of the locking assembly.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 2:
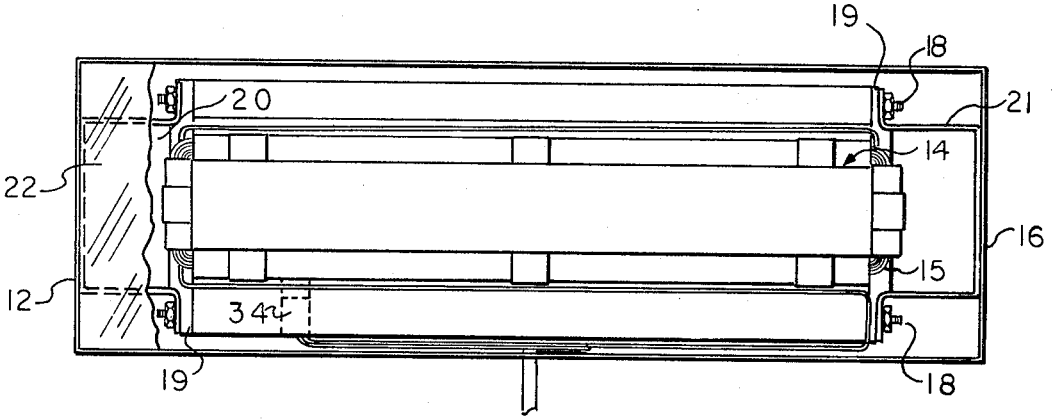
FIG. 2 is a top view of the lower component of the locking assembly, as seen in FIG. 1.
Figure 1:
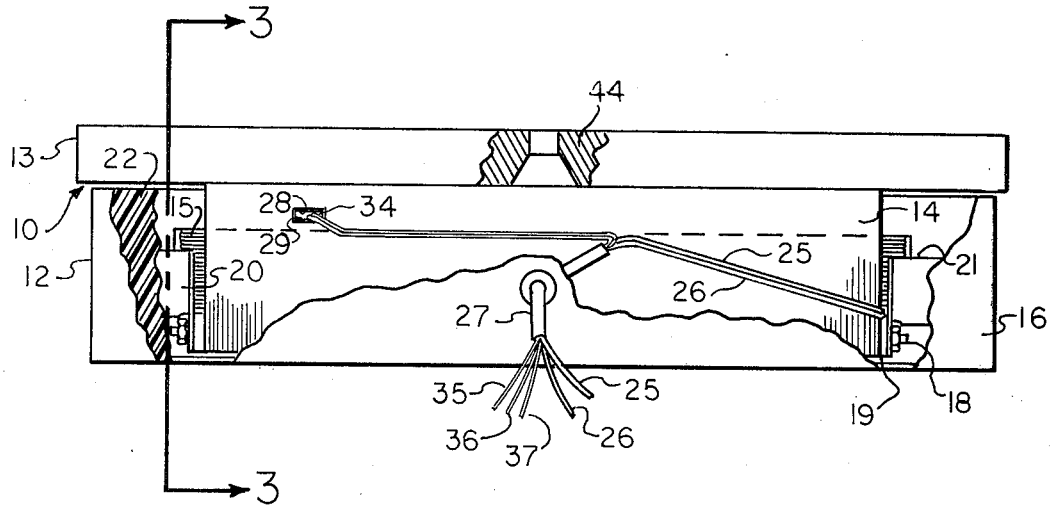
FIG. 1 is a side view of a magnetic locking assembly according to a preferred embodiment of the subject invention, with parts selectively broken away for better visibility of components.
Figure 3:
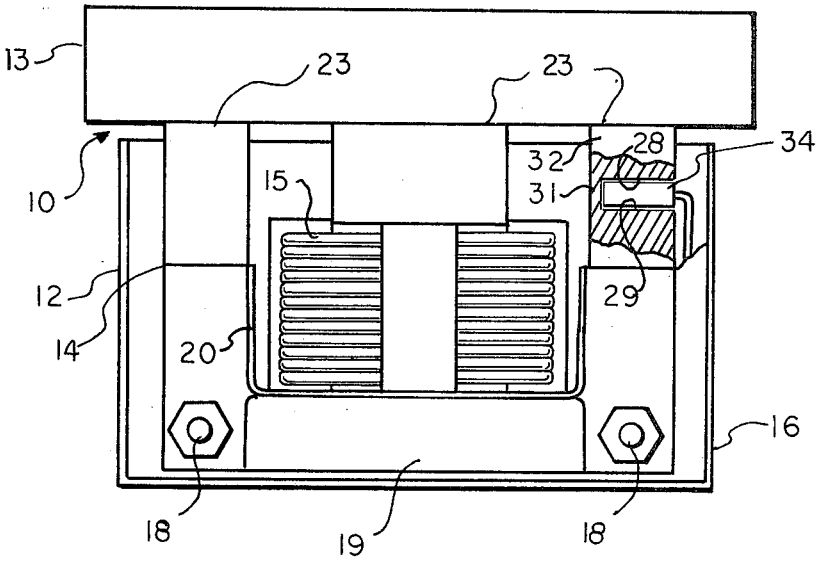
FIG. 3 is a section along the line 3—3 in FIG. 1.

The magnetic locking assembly 10 shown in FIGS. 1 to 3 is composed to matching first and second magnetizable components 12 and 13. The first component 12 may be termed a magnetic armature, including magnetic core 14 and winding 15 in a magnetic shielding box 16. By way of example, the second component 13 of the magnetic locking assembly 10 is a magnetically attractable striker plate. Also by way of example, the magnetic armature 12 may be mounted in a doorjamb, while the striker plate 13 is then mounted on a door for forceful retention by the armature 12 upon magnetization thereof.

In the preferred embodiment shown in FIGS. 1 to 3, the core 14 is of the E-shaped type and is composed of laminations. In particular, the core 14 is composed of a stack of E-shaped laminates held together by through screws 18 with the aid of I-shaped laminates 19 and generally U-shaped brackets 20 and 21. An electromagnetic coil or winding 15 is disposed on the central leg of the magnetic core 14.

The magnetic core stack with electromagnetic winding may be retained in the assembly box 12 by a cast epoxy resin or other suitable potting compound 22, only part of which has been shown in FIGS. 1 and 2. The box 12 preferably is of magnetic material so as to perform a magnetic shielding function with respect to core and winding 14 and 15.

The first component or core 14 has main pole faces 23 facing the striker plate 13 or, broadly, facing the other of the components 12 and 13. In FIGS. 1 and 3, the core 14 is shown as projecting slightly from the top of the box 12.

It may, however, be preferable in practice for the core 14 to be flush with the top of the box 12 and potting compound 22 at the pole faces 23.

The first and second components 12 and 13 are magnetically attracted into mating relationship until a predetermined magnetic flux is established in at least one of these components. In the preferred embodiment shown in FIGS. 1 to 3, this magnetic attraction is accomplished by energizing the winding 15 with an electric current of sufficient strength via wires or main leads 25 and 26 extending through tubing 27. In general, however, there are many known ways of establishing magnetic attraction between components 12 and 13. By way of example, the component 12 may be provided with a permanent magnet, rather than with a winding 15, and a switchable magnetic path may then be established to selectively energize the magnetic core 14 or pole faces 23 from such permanent magnet. As is well known, such switchable permanent magnet fields are frequently employed in magnetic mounting structures, in which case the component 13 may be a magnetizable support, with the component 12 then being a magnetic mounting base releasably located thereon.

By way of further diversification, the second component 13 may be part of or attached to the frame of a rare painting or other museum object which is retained against theft by the magnetic armature 12 mounted in an adjacent wall or socket portion. In that case, attempted theft of the picture or museum piece may effectively be forestalled or immediately countered.

Conversely, the components 12 and 13 may be part of electromagnetic lifters or couplings, to mention only a few of the many systems in which the subject invention has utility.

The general objective in all these instances is to magnetically attract the components of the assembly into mating relationship until a predetermined magnetic flux is established for the realization of a desired or necessary holding power. According to the subject invention, such predetermined magnetic flux is monitored for a detection of locking power diminutions between the components.

In terms of the illustrated embodiment of FIGS. 1 to 3, the electromagnetic winding 15 is energized via main leads 25 and 26 in order to magnetically attract the first and second components 12 and 13 into mating relationship until a predetermined magnetic flux is established in the component 12 or, more specifically, in the magnetic core 14. In accordance with the illustrated embodiment, that magnetic flux is monitored to detect diminutions in locking power between the components 12 and 13 or, more specifically, between the armature or magnetic core 14 and the striker plate 13.

According to the preferred embodiment of the subject invention shown in FIGS. 1 to 3, a pair of magnetic pole faces 28 and 29 is provided in one of the components 12. According to the best mode presently contemplated of carrying the subject invention into effect, the pole faces 28 and 29 are provided in the magnetic core 14.

In particular, the pole faces 28 and 29 are preferably provided as auxiliary pole faces which are present in the one component 12 or core 14 in addition to the main pole faces 23. It may be recalled at this juncture, that the main pole faces 23 are located on the one component 12 or core 14 and are facing in the direction of the other component 13.

In the course of the operation of the locking assembly, the first and second components 12 and 13 are magnetically attracted into mating relationship until or whereby a predetermined magnetic flux is established between the pole faces 28 and 29. In accordance with an embodiment of the subject invention, such magnetic flux between pole faces 28 and 29 may be restricted in magnitude by the provision of a magnetic isthmus 31 in parallel to the pair of magnetic pole faces 28 and 29 as best seen in FIG. 3. In practice, the isthmus 31 may be an integral part of the core 14 itself and may, for instance, be provided by notching the particular leg of the core 14 at a depth smaller than the particular width or depth of the leg.

By way of example, the magnetic component 12 may have a magnetic core 14 including a leg 32 having a main pole face 23 facing the other component 13 of the magnetic locking assembly 10, with the mentioned pair of pole faces 28 and 29 being provided in that leg 32, as seen in FIG. 3.

It may thus broadly be said, in accordance with an embodiment of the subject invention, that the pole faces 28 and 29 are auxiliary pole faces present in the one component 12 or core 14 in addition to the main pole faces 23.

In principle, the auxiliary pole faces 28 and 29 could be provided externally of the core 14 itself, or could be provided in any accessible part thereof. The illustrated location of the pole faces 28 and 29 is, however, preferred in terms of such parameters as sensitivity, reliability, reproducibility, and accessibility.

In general terms, the auxiliary pole faces 28 and 29 are located in the leg 32 at a distance from the main pole face 23. Also, the pair of pole faces 28 and 29 extend over an area of the leg 32 smaller than an entire cross-section of that leg. This, as mentioned above, may provide the magnetic isthmus 31 in the core or leg itself.

In terms of practical implementation, the pole faces 28 and 29, the isthmus 31 and the space therebetween are conveniently provided by notching between one and two dozens of the E-shaped laminates for each core at one of their outside legs 32. Such notched laminates are then stacked together to provide the accommodation space for a magnetic flux sensing device within the general stack of the core 14.

Within the broad scope of the subject invention, various magnetic flux detecting, sensing or measuring devices may be employed in monitoring the above mentioned predetermined flux.

In accordance with a preferred embodiment of the subject invention, the above mentioned predetermined flux is monitored by implementing a Hall effect between the pair of pole faces 28 and 29.

One or more Hall-effect devices 34 may thus be provided between the pair of pole faces 28 and 29 in the above mentioned flux monitoring means. As is well known, a Hall-effect device makes use of the fact that electrons and holes in a semiconductor material react not only to electric fields, but also to magnetic fields. A voltage may thus be developed across a semiconductor which carries an electric current and is placed in a magnetic field perpendicular thereto. The magnetic field deflects moving electrons to one side of the semiconductor, thereby creating the so-called "Hall voltage" which is proportional in intensity to the current flow through the semiconductive material and to the strength of the applied magnetic field. Hall-effect devices can thus be used to measure magnetic field strength or, generally, to monitor the existence or establishment of a predetermined magnetic flux.

"Intermetallic" compounds such as indium arsenide and indium antimonide are capable of high charge-carrier mobility in Hall-effect devices. In general, the greater the charge-carrier mobility, the greater the Hall voltage output. Various Hall-effect devices are commercially available.

The Hall-effect device or devices 34 are preferably provided with three leads, including leads 35 and 36 for supplying the requisite electric current to the Hall-effect device or devices, and a lead 37 for deriving the Hall voltage or a current proportional to such voltage therefrom.

Figure 4:
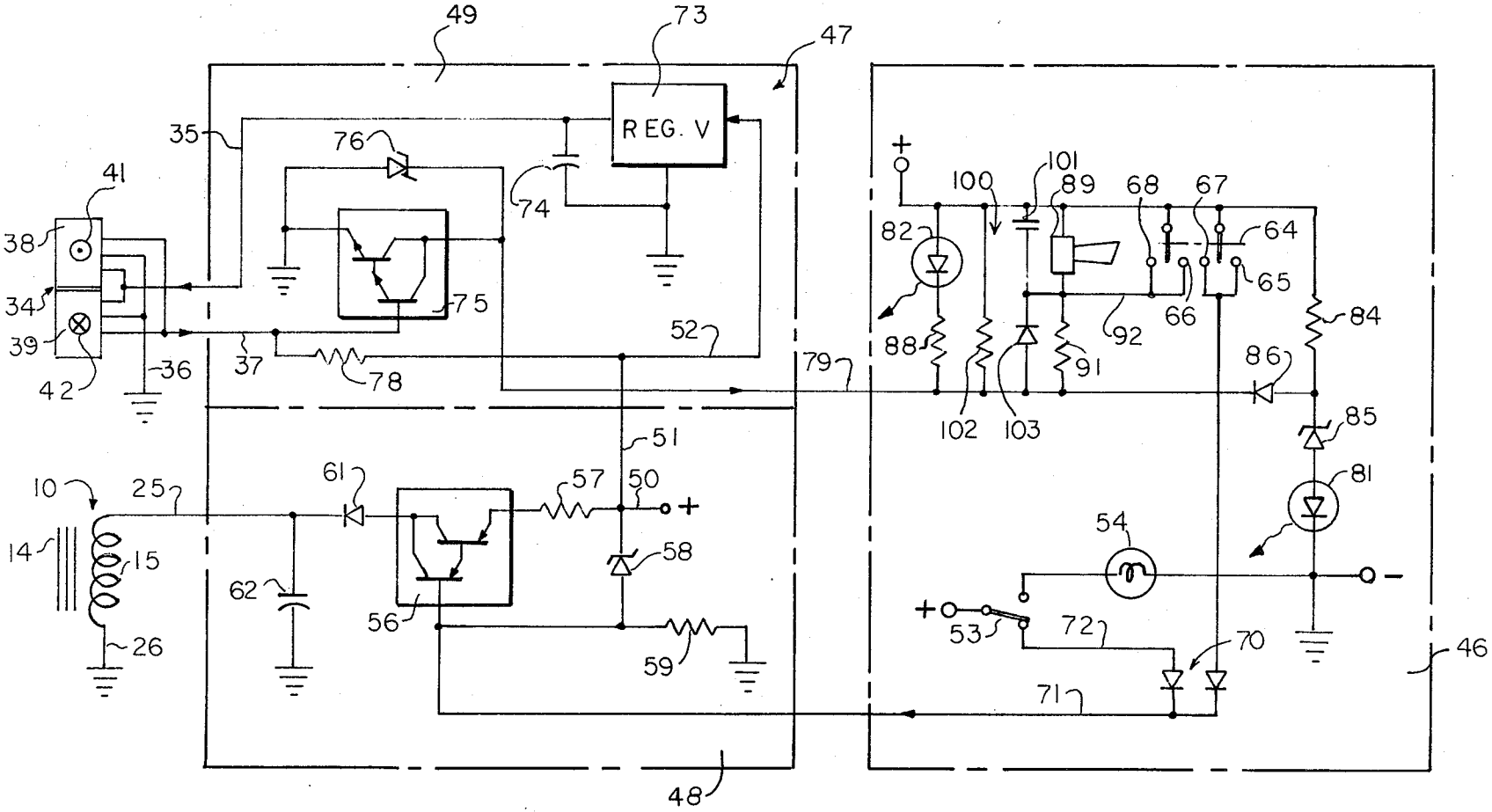
FIG. 4 is a circuit diagram of a magnetic lock actuation, status detection, surveillance and indication system according to a preferred embodiment of the subject invention.

In practice, while one Hall-effect device would be satisfactory at 34, it would render the magnetic flux monitoring function polarity sensitive as far as, for instance, the polarity of the energizing voltage applied to the main leads 25 and 26 or the direction of the magnetic flux in the core 14 is concerned. Accordingly, the subject invention, pursuant to a preferred embodiment thereof, provides a pair of oppositely oriented Hall-effect devices between the pair of pole faces 28 and 29. In accordance with the embodiment shown in FIG. 4, the monitoring means or Hall-effect sensor 34 includes a pair of Hall-effect devices 38 and 39, which are oppositely poled or oriented as symbolically illustrated by the arrow symbols 41 and 42, and which are preferably inserted between the auxiliary pole faces 28 and 29 in the core 14. The Hall devices 38 and 39 may be electrically connected in parallel as seen in FIG. 4. The flux sensing or monitoring is thus independent of the polarity of the electric energizing current and of the direction of the magnetic flux in the locking assembly.

In practice, it has been found advantageous to maintain the flux sensing operation out of the influence of certain magnetic flux path discontinuities. For instance, if the component 13 has a discontinuity in its magnetic flux path, such as a discontinuity caused by the presence of a mounting hole 44, then it has been found advantageous to laterally offset the magnetic pole faces 28 and 29 or the sensing device 34 from such magnetic flux path or magnetic field discontinuity.

The circuitry shown in FIG. 4 includes magnetic flux actuation, surveillance, status detection, indication and alarm facilities.

In particular, the circuitry of FIG. 4 includes a guardhouse or desk top actuator 46 and a controller 47 including a magnetic lock energizing unit 48 and a magnetic lock status detection or monitoring unit 49. In practice, there may be as many units 48 and 49 as there are magnetic locking assemblies or locks. These units may be directly energized from a power supply (not shown) via leads 50, 51 and 52. The system has a main switch 53 for actuating and deactivating all locks simultaneously. Upon closure of the switch 53, a signal lamp 54 lights up and indicates that the system is operating.

A PNP-type darlington transistor pair 56 is supplied with direct-current power via a current limiting resistor 57. A series-connected zener diode 58 and grounded resistor 59 provide a reference voltage at the base of darlington 56.

The darlington 56 acts as a coil driver in supplying energizing power to the winding 15 of the lock 10 via a diode 61 and lead 25 also shown in FIG. 1. A capacitor 62 is connected between the output of diode 61 and ground, in parallel to the magnetic lock winding 15. The diode 61 protects the darlington 56 from voltage spikes and transients occurring at the lock winding 15.

The capacitor 62, on the other hand, forms a damped oscillating circuit with the coil 15, thereby aperiodically degaussing the magnetic core upon deenergization of the coil 15.

A lock may be opened by actuation of a ganged double-pole double-throw switch 64. This compound switch 64 has a solidly illustrated rest position between stationary contacts. This switch further has a first active position in which the movable switch elements individually engage stationary contacts 65 and 66, and an opposite second active position in which the movable switch elements individually engage stationary contacts 67 and 68. The first and second active positions of switch 64 are equivalent in effect. Their difference is that the switch 64 will remain in the first active position only momentarily as long as its actuator is depressed, but will remain in its second active position until returned to its illustrated inactive condition. The switch 64 may thus be actuated to its first active position if only a momentary opening of the lock 10 is desired. On the other hand, the switch 64 may be actuated to its second active position if the lock 10 is to be opened for a longer time. In either case, opening of the lock proceeds by applying via switch 64 and a lead 71 a positive potential to the base of the darlington 56. The coil 15 is thus deenergized and the core 14 of the lock is degaussed as described above with the aid of the capacitor 62. In the quiescent condition of the system, the switch 53 is open as solidly illustrated in FIG. 4, thereby biasing the base of the darlington 56 positively via a lead 72 and OR-element 70 and causing deenergization of all locks.

The status of the lock 10 is continuously surveyed by the monitoring unit with the aid of the above mentioned Hall-effect assembly 34. To this end, the two parallel-connected Hall-effect devices 38 and 39 in the assembly 34 are energized via leads 50, 51 and 52, a voltage regulator 73, and lead 35. A filter capacitor 74 is connected between the output of the voltage regulator 73 and ground.

The Hall-voltage output of the assembly 34 is applied via signal return lead 37 to the base of an NPN-type darlington-connected transistor pair 75, which has a zener diode 76 connected across its output emitter/collector pair. The base of the darlington 75 is positively biased via lead 52 and resistor 78.

The Hall-effect assembly 34 and unit 49 thus monitor the above mentioned established predetermined flux between the pole faces 28 and 29 in the core 14 in order to detect locking power diminutions between the components 12 and 13 of the locking assembly 10. In particular, in response to the Hall voltage or signal received from the assembly 34, the darlington 75 applies a "lock locked" status signal via a lead 79 to the actuator unit 46. Through the use of gating logic, two signal lights 81 and 82 are actuated from the same signal line 79.

In particular, a light emitting diode (LED) 81 is lit via a resistor 84 and zener diode 85 when the magnetic locking assemblies are locked. In that case, the darlington 75 of the monitoring unit 49 applies a zero-level lock status signal via signal line 79.

On the other hand, if the Hall-effect assembly 34 senses a flux or locking power diminution, the darlington 75 in effect shorts out the LED 81 and zener drop at 85 via a diode 86 and line 79. The monitoring unit 49 thus turns off the LED 81, thereby indicating to the operator or guard that the status of maximum holding power does no longer exist for the lock 10, be it because of lack of adequate energization, surreptitious taping of a pole face 23, forceful opening of the locking assembly 10, deterioration of the lock, or for any other reason. The Hall-effect devices 38 and 39 may be provided with conventional booster amplifiers (not shown) in the chip 34.

Simultaneously, the second LED 82 is lit via lead 79 and resistor 88, indicating the unlocked or inadequately locked status of the locking assembly 10. Also at the same time, a horn 89 or other alarm device is actuated via a resistor 91, apprising the operator or guard of a situation requiring immediate remedial action. The same effect occurs if the leads 35 and 36 are cut or shorted, whereby the base of the darlingtin 75 is positively biased via resistor 78.

A time delay device 100 including capacitor 101, resistor 102 and diode 103 may be combined with the alarm device 89 in order to prevent false alarms upon switching of the lock energization.

In order to enable the alarm device 89 to distinguish between a lock status that requires remedial action and a voluntary opening of the lock, the stationary contacts 66 and 68 of the switch 64 are connected to the junction between the alarm device 89 and the resistor 91 by a lead 92. Accordingly, the alarm device 89 is electrically shunted and thus remains silent if the switch 64 is actuated to a lock opening position. Nevertheless, the LED 82 in the embodiment shown in FIG. 4 still signals that the lock 10 is in fact open.

Accordingly, it may be seen that the magnetic flux in the assembly 10 or core 14 is switchable to an "off" condition for releasing one of the components, such as the striker plate 13 from the other of the components, such as the electromagnetic armature 12. The monitoring unit 49 responds to a switching of the magnetic flux to the mentioned "off" condition by signaling via LED 82 a locking power diminution or open lock condition between the component 12 and 13. The actuator 46 and monitoring unit 49 also provide an alarm condition in response to a detected locking power diminution. As mentioned above, such alarm condition may be manifested via a horn 89 or other alarm device. In the illustrated preferred embodiment, however, such alarm condition is inhibited in response to a deliberate switching of the magnetic flux to the above mentioned "off" condition.

In the past, certain intruders and saboteurs have had a certain measure of success in defeating or impeding the operation of magnetic locking assemblies by the use of external magnetic fields. To counter such surreptitious activity, the subject invention provides methods and means for detecting an external magnetic field applied to the locking assembly in an attempt to counterfeit the internal magnetic field generated in the core 14 by the energized winding 15.

The subject invention according to its latter aspect also indicates such detected applied external magnetic fields for prompt remedial action.

Figure 5:
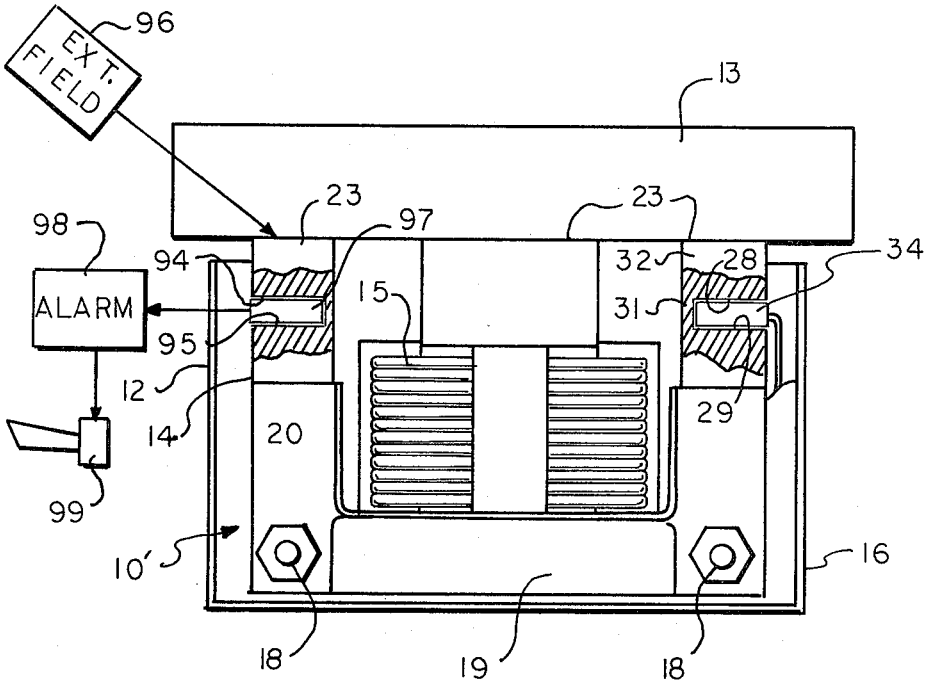
FIG. 5 is a view similar to FIG. 3 showing a facility for detecting attempts at defeating the magnetic locking assembly, with FIGS. 3 and 5 being on a somewhat enlarged scale relative to their corresponding FIGS. 1 and 2.

Within the broad context of the latter aspect of the subject invention, the means for detecting and indicating external magnetic fields applies to the locking assembly 10 in an attempt to counterfeit the predetermined magnetic flux between the auxiliary pole faces 28 and 29 may take various forms and shapes in practice. By way of preferred example, a second pair of magnetic pole faces 94 and 95 may be provided in the one component 12 or in a leg of the magnetic core 14, as shown in FIG. 5. A second magnetic flux occurs between that second pair of magnetic pole faces 94 and 95 upon application of an external magnetic field, symbolically illustrated in FIG. 5 at 96. Also by way of preferred example, a Hall-effect device or assembly 97 similar to the devices or assembly 34 shown in FIGS. 1 to 4 may be employed for this purpose.

In particular, an alarm circuit 98 similar to the monitoring unit 49 may be employed to energize a second horn or other alarm device 99 in response to imposition of an external magnetic field 96 onto the locking assembly 10' shown in FIG. 5. In practice, the alarm circuit 98 may be set to cause an alarm 99 when a field occurs in the core 14 at 94 and 95 which is different in intensity from the field normally occurring upon energization of the magnetic armature winding 15 in response to energization via unit 48. In this respect, all kind of devices available to those skilled in the art may be employed at 98 to signal various alarm conditions, such as those prompted by the occurrence of an unsteady magnetic field caused by attempts at fiddling with the lock with the aid of magnets and the like.

Various modifications and variations within the spirit and scope of the subject invention will be suggested or become apparent to those skilled in the art on the basis of the subject extensive disclosure.

I claim:

1. In a method of operating a magnetic locking assembly having matching first and second magnetizable components, the improvement comprising in combination the steps of:

magnetically attracting said first and second components into mating relationship whereby a predetermined magnetic flux is established in one of said components; and monitoring said established predetermined flux to detect locking power diminutions between said components.

2. A method as claimed in claim 1, wherein:

said magnetic flux is switchable to an "off" condition for releasing one of said components from the other of said components; and said monitoring responds to a switching of the magnetic flux to said "off" condition by signaling a locking power diminution between said components.

3. A method as claimed in claim 1, including the step of:

providing an alarm indication in response to a detected locking power diminution.

4. A method as claimed in claim 3, wherein:

said magnetic flux is switchable to an "off" condition for releasing one of said components from the other of said components; and said alarm indication is inhibited in response to a switching of the magnetic flux to said "off" condition.

5. In a method of operating a magnetic locking assembly having matching first and second magnetizable components, the improvement comprising in combination the steps of:

providing a pair of magnetic pole faces in one of said components;

magnetically attracting said first and second components into mating relationship whereby a predetermined magnetic flux is established between said pole faces; and monitoring said established predetermined flux between said pole faces to detect locking power diminutions between said components.

6. A method as claimed in claim 5, wherein:

said pole faces are auxiliary pole faces provided in said one component in addition to main pole faces on said one component facing the other of said components.

7. A method as claimed in claim 5 or 6, including the step of:

providing a magnetic isthmus in parallel to said pair of magnetic pole faces restricting said magnetic flux in magnitude.

8. A method as claimed in claim 7, including the step of:

monitoring said established predetermined flux by implementing a Hall effect between said pair of pole faces.

9. A method as claimed in claim 5, including the steps of:

providing said one component with a magnetic core including a leg having a main pole face facing the other of said components; and providing said pair of pole faces in said leg.

10. A method as claimed in claim 9, wherein:

said pair of pole faces are provided in an area of said leg smaller than an entire cross-section of said leg.

11. A method as claimed in claim 5, 6, 9 or 10, including the step of:

monitoring said established predetermined flux by implementing a Hall effect between said pair of pole faces.

12. A method as claimed in claim 5, 6, 9 or 10, wherein:

the other of said components has a magnetic flux path discontinuity; and said pair of magnetic pole faces is laterally offset from said discontinuity.

13. A method as claimed in claim 5, 6, 9 or 10, including the steps of:

providing a second pair of magnetic pole faces in said one component;

detecting a second magnetic flux occurring between said second pair of magnetic pole faces upon application of an external magnetic field to said one component; and monitoring said detected second magnetic flux.

14. A method as claimed in claim 9, including the steps of:

providing in said magnetic core a second pair of magnetic pole faces;

detecting a second magnetic flux occurring between said second pair of magnetic pole faces upon application of an external magnetic field to said one component; and monitoring said detected second magnetic flux.

15. In apparatus for operating a magnetic locking assembly having matching first and second magnetizable components, the improvement comprising in combination:

means for magnetically attracting said first and second components into mating relationship whereby a predetermined magnetic flux is established in one of said components; and means coupled to said attracting means for monitoring said established predetermined flux to detect locking power diminutions between said components.

16. Apparatus as claimed in claim 15, wherein:

said attracting means include means for rendering said magnetic flux switchable to an "off" condition for releasing one of said components from the other of said components; and said monitoring means include means responding to a switching of the magnetic flux to said "off" condition by signaling a locking power diminution between said components.

17. Apparatus as claimed in claim 15, including:

means connected to said monitoring means for providing an alarm indication in response to a detected locking power diminution.

18. Apparatus as claimed in claim 17, wherein:

said attracting means include means for rendering said magnetic flux switchable to an "off" condition for releasing one of said components from the other of said components; and said alarm indication providing means include means for inhibiting said alarm indication in response to a switching of the magnetic flux to said "off" condition.

19. In apparatus for operating a magnetic locking assembly having matching first and second magnetizable components, the improvement comprising in combination:

a pair of magnetic pole faces in one of said components;

means for magnetically attracting said first and second components into mating relationship whereby a predetermined magnetic flux is established between said pole faces; and means coupled to said attracting means for monitoring said established predetermined flux between said pole faces to detect locking power diminutions between said components.

20. Apparatus as claimed in claim 19, wherein:

said pole faces are auxiliary pole faces present in said one component in addition to main pole faces on said one component facing the other of said components.

21. Apparatus as claimed in claim 19 or 20, including:

means for restricting said magnetic flux in magnitude, including a magnetic isthmus in parallel to said pair of magnetic pole faces.

22. Apparatus as claimed in claim 21, wherein:

said monitoring means include a Hall-effect device between said pair of pole faces.

23. Apparatus as claimed in claim 21, wherein:

said monitoring means include a pair of oppositely oriented Hall-effect devices between said pair of pole faces.

24. Apparatus as claimed in claim 19, wherein:

said one component has a magnetic core including a leg having a main pole face facing the other of said components, and having said pair of pole faces located therein at a distance from said main pole face.

25. Apparatus as claimed in claim 24, wherein:

said pair of pole faces extend over an area of said leg smaller than an entire cross-section of said leg.

26. Apparatus as claimed in claim 19, 20, 24 or 25, wherein:

said monitoring means include a Hall-effect device between said pair of pole faces.

27. Apparatus as claimed in claim 19, 20, 24 or 25, wherein:

said monitoring means include a pair of oppositely oriented Hall-effect devices between said pair of pole faces.

28. Apparatus as claimed in claim 19, 20, 24 or 25, wherein:

the other of said components has a magnetic flux path discontinuity; and said pair of magnetic pole faces is laterally offset from said discontinuity.

29. Apparatus as claimed in claim 19, 20, 24 or 25, including:

a second pair of magnetic pole faces in said one component;

means for detecting a second magnetic flux occurring between said second pair of magnetic pole faces upon application of an external magnetic field to said one component; and means connected to said detecting means for monitoring said detected second magnetic flux.

30. Apparatus as claimed in claim 24, including:

a second pair of magnetic pole faces in said magnetic core;

means for detecting a second magnetic flux occurring between said second pair of magnetic pole faces upon application of an external magnetic field to said magnetic core; and means connected to said detecting means for monitoring said detected second magnetic flux.

* * * * *